United States Patent [19]

Noguchi

[11] Patent Number: 5,076,341

[45] Date of Patent: Dec. 31, 1991

[54] COMPRESSION CASTING METHOD AND APPARATUS THEREFOR

[75] Inventor: Keiichiro Noguchi, Higashihiroshima, Japan

[73] Assignee: Mazda Motor Corporation, Hiroshima, Japan

[21] Appl. No.: 647,355

[22] Filed: Jan. 29, 1991

[30] Foreign Application Priority Data

Feb. 6, 1990 [JP] Japan ..... 2-26909

[51] Int. Cl.[5] ..... B22D 27/13

[52] U.S. Cl. ..... 164/120; 164/4.1; 164/154; 164/284

[58] Field of Search ..... 164/120, 284, 319, 320, 164/321, 4.1, 154

[56] References Cited

U.S. PATENT DOCUMENTS 2,406,333 8/1946 Jensen ..... 164/284

FOREIGN PATENT DOCUMENTS 2422348 11/1974 Fed. Rep. of Germany ..... 164/284

2237712 2/1975 France ..... 164/120

144722 11/1980 German Democratic Rep. ..... 164/120

57-32869 2/1982 Japan ..... 164/120

1238919 7/1971 United Kingdom ..... 164/120

*Primary Examiner*—J. Reed Batten, Jr.

*Attorney, Agent, or Firm*—Fleit, Jacobson, Cohn, Price, Holman & Stern

[57] ABSTRACT

A casting is formed, by compression casting, in a mold having a casting cavity which is formed by at least an outer mold die and a sand core. After feeding a molten metal into the casting cavity through a pouring gate, a compressive pressure, maintained at a lower extreme of approximately 2.5 atmospheres, is applied to the molten metal through the pouring gate in an early stage of solidification of the molten metal. The compressive pressure is varied, either gradually or quickly, to an upper extreme of approximately 10 atmospheres as the solidifcation of the molten metal progresses past an early stage of solidification, and is at this time applied to the solidifying molten metal through the sand core.

15 Claims, 1 Drawing Sheet

COMPRESSION CASTING METHOD AND APPARATUS THEREFOR

The present invention relates to a compression casting method and apparatus therefor for forming a casting in a mold.

BACKGROUND OF THE INVENTION

A casting method known as "compression casting" has been widely used to form a casting with a dense and uniform structure, without internal structural defects, such as blow holes, and with improved mechanical properties. Typically, when metal is subjected to compression casting, as the temperature of the molten metal decreases, the metal solidifies and increases in density. Conventional compression casting methods, however, tend to produce internal structural defects, and, in particular, voids or blow holes, when the molten metal solidifies at an insufficient rate relative to a rate of drop in temperature. It is necessary to compress the molten metal sufficiently and properly in the casting cavity to permit the solidification of molten metal without the production of internal structural defects in the casting.

In compression casting, as is common in die casting, it is typical to compress molten metal in the casting cavity at a high pressure ranging between about 1,000 and 2,000 atmospheres (atms.). In order for the casting cavity resist such high pressures, metallic molds usually must be used to form the casting cavity.

In recent years, improvements in casting technology have made it possible to form a casting with no blow holes, even when a low compression pressure, such as about 1,000 atms., is used. Because of such improvements, some castings, without structural defects, can be formed with compression pressures sufficiently low so that even a sand mold can be used. For instance, as is known from Japanese Unexamined Patent Publication No. 63-137564, a sand mold, such as one made of formed casting sand, is used in compression casting. This sand mold is, after being filled with a molten metal in its cavity, compressed with a high-pressure gas in a gas chamber.

There is, however, a drawback to the conventional use of a metal or sand casting mold in compression casting. In particular, in die casting, in which a metal mold having a core is used, the metal mold typically has a pouring gate remote from its casting cavity. Therefore, a substantial loss in compression pressure applied to molten metal in the casting cavity is caused. In particular, when a metal mold with a casting cavity which is complicated in configuration, and hence, which has a large surface area, is used, the metal mold has a large heat-dissipation area. Consequently, the molten metal in the casting cavity, and, in particular, in intricate and deep sections of the cavity, tends to solidify at an early stage, so that it is difficult to exert a sufficient compression pressure on the molten metal in such sections before the metal solidifies. Since a high compression pressure must be applied to the molten metal in order to prevent formation of voids in the casting, a relatively large compression device, to exert sufficient compression pressure, is required. Thus, the risk of damaging or deforming the core of the die casting mold is brought about.

On the other hand, if a sand mold is used, a large high-pressure gas chamber with a door is also required. When such a high-pressure gas chamber is used, however, it is difficult to easily manage pouring or feeding molten metal into the casting cavity and closing the door for applying and maintaining high compression pressure. This results in inefficient casting and low productivity. Furthermore, high compression pressure has been found to adversely affect the desired close contact of the molten metal to the surface of the casting cavity. Accordingly, the molten metal solidifies slowly, resulting in a rough casting structure and poor mechanical properties. Additionally, an ill-timed or delayed application of compression pressure, after the molten metal has been completely fed or poured into a casting cavity having a complicated configuration, brings about an early partial solidification of the molten metal, particularly in intricate and deep sections of the casting cavity. Thus, it is difficult to exert a uniform compression pressure over the whole area.

SUMMARY OF THE INVENTION

A primary object of the present invention is to provide a method of and an apparatus for forming a casting in a sand mold by compression casting without the use of a of high-pressure gas chamber of unduly large size.

It is another object of the present invention to provide a compression casting method and an apparatus therefor for forming a casting in a sand mold by compression casting without applying a high compression pressure to molten metal in the sand mold.

According to the present invention, a casting cavity of a casting mold with a pouring gate is made of an outer mold and a sand core. After feeding a molten metal into the casting cavity through a pouring gate, a compression pressure, maintained at a lower extreme, such as approximately 2.5 atms., is applied to the molten metal through the pouring gate during an early stage of solidification of the molten metal. This early state is considered to end when approximately 40% of the molten metal reaches a solid phase. The compression pressure is varied, either quickly or gradually, to an upper extreme of approximately 10 atms. as the solidification of the molten metal progresses past the early stage of solidification, i.e., when more than approximately 40% of the molten metal has solidified. The compression pressure is applied to the solidifying molten metal through the sand core.

To apply the compression pressure at the lower extreme to the molten metal through the pouring gate, after feeding the molten metal into the mold, a pressure head is removably brought into contact with the casting mold over the pouring gate to form an air-tight chamber covering the pouring gate. The pressure head connects the air-tight chamber to pressure generating means. The compression pressure is then varied, i.e., regulated, by pressure control means through a first fluid passage so as to apply pressure at a lower pressure extreme of approximately 2.5 atm. into the air-tight chamber. At the end of the early stage of solidification of the molten metal, when approximately 40% of the molten metal has reached the solid phase, the compression pressure is varied, either quickly or gradually, by the control means to a higher pressure extreme of approximately 10 atm. The compression pressure, thus varied, is introduced into the sand core through a second fluid passage which connects the pressure generating means to the sand core, and is applied to the molten metal through the sand core.

BRIEF DESCRIPTION OF THE DRAWINGS

The above and other objects and features of the present invention will be apparent from the following description of a preferred embodiment thereof, when considered in conjunction with the appended drawings, in which.

DETAILED DESCRIPTION OF THE PREFERRED EMBODIMENT

Figure 1:
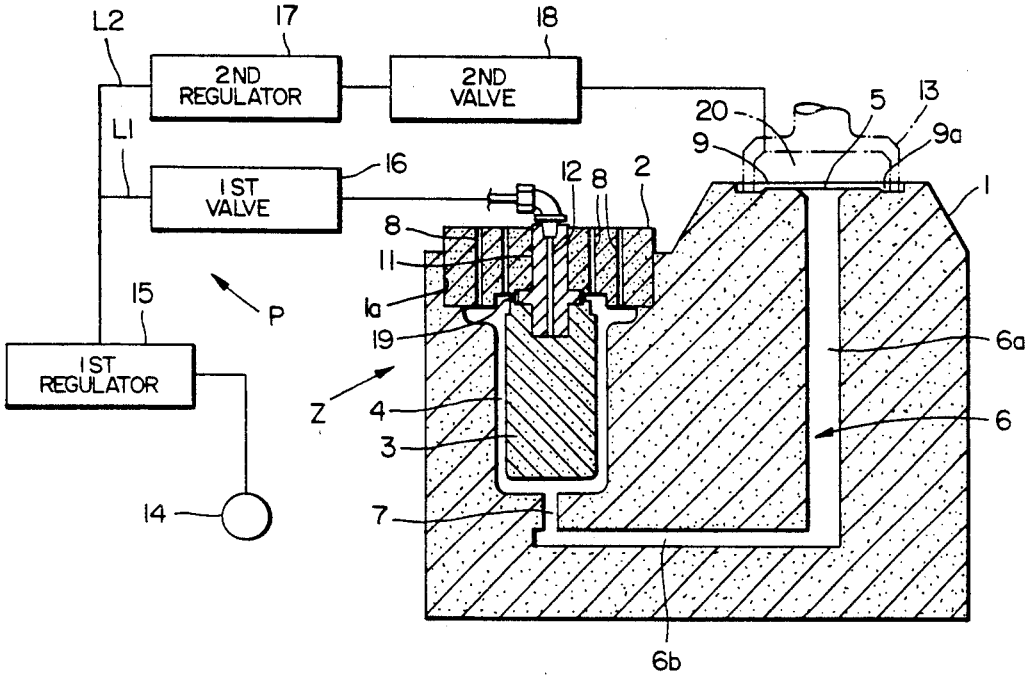
FIG. 1 is a partly schematic, cross-sectional view of a compression casting apparatus in accordance with a preferred embodiment of the present invention.

Referring to the drawings, and in particular to FIG. 1, a compression casting apparatus according to a preferred embodiment of the present invention is shown, partly in cross section. The illustrated apparatus is preferably used for casting an aluminum alloy part having a maximum diameter of, for instance, 100 mm, and which includes a hollow cylindrical body and an annular flange. The casting apparatus includes a casting mold Z having a first main, lower casting mold die 1, a second main, upper casting mold die 2, and an approximately cylindrical core 3. A casting cavity 4 is formed between an outer surface of cylindrical core 3, an inner surface of first casting mold die 1, and an inner surface of second casting mold die 2. At least the core 3, or, if desirable, the casting mold Z in its entirety, is made of self-hardening, casting sand, such as grade 6 ganister sand, containing a resinous hardener, such as epoxy. At least core 3 is formed of ganister sand, and is air permeable. Optionally, the dies 1 and 2 are also of ganister sand, and are air permeable as well.

Lower mold die 1 is formed with a pouring gate 6, extending between an inlet gate 5, formed in a top surface of the lower mold die 1, and an outlet gate 7 in the lower mold die which opens into the casting cavity 4. The pouring gate 6 comprises a vertical section **6*a*, extending downward to near the bottom of the lower mold die 1 from the inlet gate 5, and a horizontal section 6*b*, disposed at a right angle relative to the vertical section, extending from the bottom of the vertical section 6*a* to a location near one side of the lower mold die 1 remote from the vertical section 6*a*. The vertical section 6*a* has an inner diameter approximately two times the inner diameter of the horizontal section 6*b*. Horizontal section 6*b* may, for example, have an inner diameter of about 10 mm. The pouring gate 6 communicates, at the end of the horizontal section 6*b*, with the outlet gate 7, which extends vertically upward to the casting cavity 4. Outlet gate 7 has an inner diameter of about 8 mm. Thus, by vertical section 6*a*, horizontal section 6*b* and outlet gate 7, the pouring gate 5 communicates with the casting cavity 4. The lower mold die 1 is further formed, in its top surface, with a circular basin 9 surrounded by an annular groove 9*a*. A pressure head 13, in the form of a cylindrical cap, is movable up and down by a drive mechanism (not shown), such as one including a hydraulic cylinder, and cooperates with the annular groove 9*a* to form an air-tight pressure chamber 20 covering the inlet gate 5 when it has been moved down into contact with the bottom of basin 9**.

Upper mold die 2 is shaped to fit in an opening on recess **1*a* so as to cooperate with the lower mold die 1 and form casting cavity 4. The upper mold die 2 is formed with a plurality of vertical passages 8** for degassing.

Figure 2:
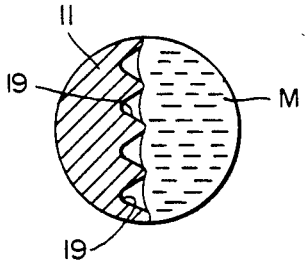
FIG. 2 is an enlarged, cross-sectional view, showing partially the interface between a molten metal and a mounting for a core in a stage before a compression pressure is applied to the molten metal.
Figure 4:
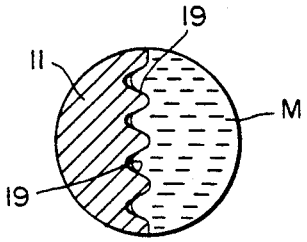
FIG. 4 is an enlarged, cross-sectional view, similar to FIG. 2, but in a stage after compression pressure has been applied to the molten metal.

Core 3 is supported by a core mounting element 11, known as a "print", formed with a fluid passage 12 for gas supply. Core print 11 is in the form of a rod made of metal, such as stainless steel, and is attached to and held in place by the upper mold die 2. As is shown in FIGS. 1, 2 and 4, the core print 11 has, on a small flange portion thereof, a spiral thread formed by a plurality of adjacent, circumferentially extending grooves 19. Such a spiral thread is formed, in the illustrated embodiment, by cutting grooves with 1.25 threads per mm. into the circumferential exterior surface of the flange portion. The spiral thread is thus formed in that part of a surface of the core print 11 that is exposed to the casting cavity 4.

A pressure delivery system, or control unit, generally designated by a reference character P, includes a pressure generator, such as an air compressor 14. The air compressor 14 delivers and applies pressure into both the core 3 and the pressure chamber 20. The pressure delivery system P comprises two sets of regulators and control valves. The first set includes regulator 15 and control valve 16, while the second set includes regulator 17 and control valve 18. The compressor 14 is communicated with the fluid passage 12 of the core print 11 through pressure line L1, including the first regulator 15 and control valve 16, so as to supply regulated compressed gas, such as air, and force it to penetrate into the core 3. The compressor 14 is also communicated with the pressure chamber 20 in the pressure head 13 through pressure line L2, branching off from the pressure line L1 between the first regulator 15 and control valve 16, and including the second regulator 17 and control valve 18, so as to supply regulated compressed gas into the pressure chamber 20. The pressure delivery system P, including the pressure head 13, may be an automatic control unit, operated by a program controlled robot, and performs a casting process as will be described.

Pressure output from the compressor 14 is regulated and adjusted, in a known manner, to 10 atm. by the first regulator 15, and to 2.5 atm. by the second regulator 17. Both the first and second control valves 16 and 18 independently open and shut the pressure lines L1 and L2, respectively.

The process of forming a casting, such as an aluminum alloy cylindrical part with an annular flange, by the use of the compression casting apparatus depicted in FIG. 1 requires several preparation steps. Before assembling the lower and upper mold dies 1 and 2 and the core 3 together, surfaces of the mold dies 1 and 2 and core 3 which are expected to form the casting cavity 4 are coated with a facing agent to help prevent intrusion, i.e., penetration, of molten metal into the mold dies 1 and 2 and core 3 when the molten metal is compressed. Then, the upper mold die 2, to which the core has been secured, is fitted into the opening **1*a* of the lower mold die 1 to form a precisely designed casting cavity 4**.

When all the preparations have been made, molten metal, such as a molten aluminum alloy, is fed into inlet gate 5 and through pouring gate 6 and outlet gate 7 into the casting cavity 4 until the casting cavity 4, outlet gate 7, pouring gate 6 and basin 9 are filled with the molten metal. During this time, air originally in the casting cavity 4 and the pouring gate 6 escapes through the degassing passages 8 out of the casting mold Z. The molten metal enters into the degassing passages 8 and contacts the cool inner surfaces thereof. The molten metal, therefore, is quenched, and rapidly solidifies, so as to clog the degassing passages 8.

The pressure head 13 is moved from above the inlet gate 5 of the compression casting apparatus down so as to cause the rim of the pressure head 13 to penetrate into the molten metal filled in the circular basin 9 and bring the edge of the rim into contact with the annular groove 9*a* surrounding the circular basin 9, thereby forming the pressure chamber 20 over the inlet gate 5 in the circular basin 9. The molten metal in the basin 9, is contacted by the pressure head 13, is quenched, and begins solidification. The pressure chamber 20 is thereby airtightly isolated from the atmosphere.

Figure 3:
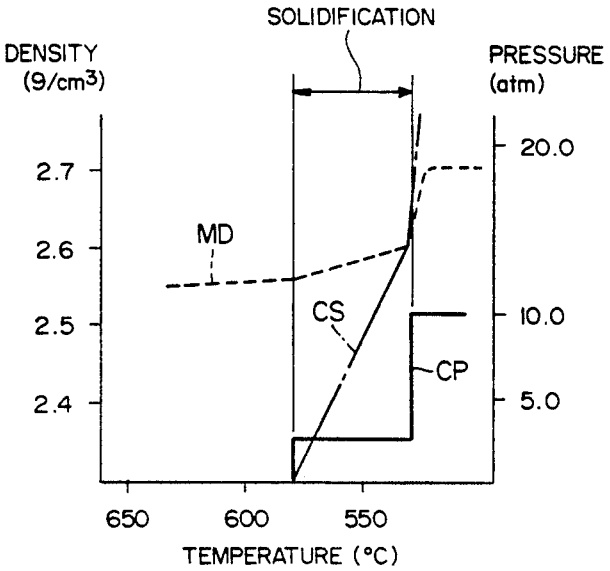
FIG. 3 is an explanatory diagram showing, in terms of their correlation to metal density, a relationship between compressive strength, compression pressure and temperature.

FIG. 3 shows the correlation of metal density (MD), compressive strength (CS), and compressive pressure (CP), relative to temperature, for a specific metal. A range of temperature in which the metal solidifies is shown as a theoretically obtained range in FIG. 3. Practically, the range shifts toward a lower temperature side due to overcooling.

As is clear from FIG. 3, at the beginning of solidification, when the molten metal is at a temperature below about 600 but above about 550 degrees Celsius, the second control valve 18 is opened to supply compressed gas or air, regulated at what is named in this specification a "primary pressure" of, e.g., approximately 2.5 atm., by the second regulator 17, into the pressure chamber 20. This application of the primary pressure as the metal solidifies is continued until about 40% of the molten metal has solidified.

During this early stage of solidification, since the metal is still mostly fluid, the pressure is substantially uniformly applied to the molten metal in the casting cavity 4. Accordingly, as is shown in FIG. 2, although surface tension prevents the molten metal M from entering the grooves 19 of the spiral thread of the core print 11 before the primary pressure into the pressure chamber 20 is applied, once the primary pressure is applied, the molten metal M enters the grooves 19, as is shown in FIG. 4, and closely contacts with surfaces of the grooves 19, so that the molten metal M between the grooves 19 is quenched and solidifies. By virtue of this rapid solidification, the casting cavity 4, between the upper mold die 2 and the core 3, is sealed. As a result, the outer portion of the casting cavity 4 is made completely airtight. The pressure in the casting cavity rapidly increases to approximately 3 atm. During the early stage of solidification, the primary pressure is received by the lower and upper mold dies 1 and 2 rather than by the molten metal, which has a compressive strength which is low at this time. The compressive strength of the molten metal increases, as the solidification progresses, up to a compressive strength, i.e., a resistance to compression, of a little less than approximately 0.15 $kgf/mm^2$ when about 40% of the molten metal has solidified.

Near the end of the early stage, when the solid phase of the metal is about 40%, the first control valve 16 is opened to supply compressed gas or air, regulated at what is named in this specification a "secondary pressure" of, for instance, approximately 10 atms., by the first regulator 15. This compressed gas penetrates through the core 3 of sand into the casting cavity and acts on the molten metal in the casting cavity 4 to continuously apply the secondary pressure to the molten metal until the metal is completely solidified. As FIG. 3 shows, the temperature of the metal at this point is less than 550 degress Celsius.

At the beginning of this secondary stage of solidification, since the compressive strength of the molten metal has been increased to above approximately 10 atms., the secondary pressure is mostly received by the molten metal itself, so that the lower and upper mold dies 1 and 2 are subjected to substantially no pressure, or, at the most, only a low pressure.

In a final stage, the casting mold Z is disassembled, and the casting, with the core print 11, is taken out. To remove the core print 11 from the casting, the core print 11, which is tightly connected to the casting through the thread, is loosened and turned relative to the casting, unscrewed, and removed.

As is apparent from the above, in the secondary stage of solidification, even though a secondary pressure of 10 atms. or higher is applied, no substantial damage to or deformation of the sand casting mold Z is caused, because the secondary pressure is absorbed entirely by the casting. The secondary pressure acts substantially through the porous, air permeable core 3 on the molten metal from a radial interior of the cavity 4. The rate of solidification of the metal is, therefore, higher toward the outer part of the casting cavity 4, on the side of the cavity adjacent lower mold die 1, than toward the inner part of the casting cavity, on the side of the cavity adjacent core 3. The reason for this will be explained shortly. Because the secondary pressure acts on the molten metal through the core 3 from the radial interior of the cavity and because the secondary pressure increasingly affects the molten metal with the progress of solidification, the molten metal is compressed, under the secondary pressure, with high efficiency during solidification, so that residual air is not held therein. Accordingly, there is very little chance that the casting will be provided with internal structural defects, such as blow holes, formed therein.

Since the molten metal is compressed from the inner side of the cylindrical cavity 4 and pressed against the mold dies 1 and 2, heat-dissipation through the mold dies 1 and 2 is enhanced, so as to cause the molten metal in contact with the mold dies 1 and 2 to solidify at a high rate. This rapid solidification produces a fine crystal structure and a high uniform density and provides the casting with improved mechanical characteristics. In addition, because it receives pressure from the whole surface of the core 3, the molten metal is compressed substantially uniformly. Therefore, the casting cavity applies sufficient pressure even to peripheral narrow recesses and intricate sections of a complex casting configuration. This further assists in forming the casting without internal structural defects, such as blow holes, and providing it with a more uniform structure.

It is to be understood that although the invention has been described in detail with respect to a preferred embodiment, nevertheless, various other embodiments and variants are possible that are within the spirit and scope of the invention, and such embodiments and variants are intended to be covered by the following claims.

What is claimed is:

1. A compressive casting method comprising the steps of:

providing a mold made up of at least one outer mold die and a sand core, by which a casting cavity having a pouring gate, is formed in the mold;

feeding a molten metal into the casting cavity through the pouring gate;

applying a primary compressive pressure, at a lower extreme, to said molten metal through the pouring gate in an early stage of solidification of said molten metal; and applying a secondary compressive pressure, at an upper extreme, to said molten metal through the sand core as solidification of said molten metal passes from said early stage of solidification to a later stage of solidification.

2. A method as recited in claim 1, wherein said primary compressive pressure, at said lower extreme, is maintained until about 40% of said molten metal has reached a solid phase.

3. A method as recited in claim 1, wherein said primary compressive pressure is approximately 2.5 and said secondary compressive pressure is approximately 10 atmospheres.

4. A method as recited in claim 3, wherein said primary compressive pressure of approximately 2.5 atmospheres is abruptly varied to said secondary compressive pressure of approximately 10 atmospheres.

5. A method as recited in claim 3, wherein said primary compressive pressure of approximately 2.5 atmospheres is varied continuously to said secondary compressive pressure of approximately 10 atmospheres.

6. An apparatus for producing a casting by compressive casting comprising:

a casting mold made up of at least one outer mold die and a core, in which casting mold a casting cavity and a pouring gate are formed, pressure generating means for generating a compressive pressure applied to the casting;

a pressure head capable of being removably brought into contact with the casting mold to form an air-tight chamber covering the pouring gate;

a first fluid passage for connecting said pressure generating means to said air-tight chamber;

a second fluid passage for connecting said pressure generating means to said core; and control means for varying said compressive pressure between an upper extreme and a lower extreme and for applying, in an early stage of solidification of a molten metal in said casting cavity, said compressive pressure at said lower extreme into said air-tight chamber and, as solidification of said molten metal progresses, said compressive pressure at said upper extreme into the core to compressively solidify said molten metal and form the casting.

7. An apparatus as recited in claim 6, wherein said control means continuously maintains said compressive pressure at said lower extreme until about 40% of said molten metal has solidified.

8. An apparatus as recited in claim 6, wherein said control means varies said compressive pressure between approximately 2.5 and 10 atmospheres to define said lower and upper extremes, respectively.

9. An apparatus as recited in claim 6, wherein said control means comprises means for regulating said compressive pressure between upper and lower extremes and valves for allowing said compressive pressure at said lower extreme to be applied into said air-tight chamber only during said early stage of solidification of said molten metal.

10. An apparatus as recited in claim 6, and further comprising core supporting means for supporting said core, said core supporting means being formed with a bore forming part of said second fluid passage.

11. An apparatus as recited in claim 10, wherein said core supporting means comprises a metal rod with a flange exposed to the casting cavity.

12. An apparatus as recited in claim 10, wherein said metal rod is provided with a thread formed on an outer periphery of said flange.

13. An apparatus as recited in claim 6, wherein said core is made of self-hardening, casting sand.

14. An apparatus as defined in claim 13, wherein said core is made of ganister sand containing a resin hardener.

15. An apparatus as defined in claim 6, wherein said outer mold die is made of sand.

* * * * *